US009397411B2

(12) United States Patent
Ito et al.

(10) Patent No.: US 9,397,411 B2
(45) Date of Patent: Jul. 19, 2016

(54) ELECTRIC WIRE WITH CRIMP TERMINAL

(71) Applicant: YAZAKI CORPORATION, Tokyo (JP)

(72) Inventors: Naoki Ito, Shizuoka (JP); Yasunori Nabeta, Shizuoka (JP); Takahito Nakashima, Aichi (JP); Hiroshi Kobayashi, Aichi (JP); Saori Yamazaki, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/795,548

(22) Filed: Jul. 9, 2015

(65) Prior Publication Data

US 2015/0372399 A1 Dec. 24, 2015

Related U.S. Application Data

(63) Continuation of application No. 13/832,361, filed on Mar. 15, 2013, now Pat. No. 9,112,288.

(30) Foreign Application Priority Data

Mar. 16, 2012 (JP) ..... 2012-060302

(51) Int. Cl.
*H01R 4/18* (2006.01)
*H01R 9/05* (2006.01)

(52) U.S. Cl.
CPC ..... *H01R 4/188* (2013.01); *H01R 9/0518* (2013.01)

(58) Field of Classification Search
CPC ..... H01R 9/0518; H01R 4/20; H01R 4/188
USPC ..... 439/877, 882, 455, 459, 203, 421, 580, 439/585, 442, 741, 430
See application file for complete search history.

(56) References Cited

U.S. PATENT DOCUMENTS 3,551,882 A * 12/1970 O'Keefe ..... H01R 24/40 439/585
4,593,964 A * 6/1986 Forney, Jr. ..... H01R 24/562 439/580

(Continued)

FOREIGN PATENT DOCUMENTS

CN 101645543 A 2/2010
JP 52-64688 A 5/1977

(Continued)

OTHER PUBLICATIONS

Chinese Office Action and Search Report for the related Chinese Patent Application No. 2013100855217 dated Jan. 16, 2015.

(Continued)

*Primary Examiner* — Felix O Figueroa
(74) *Attorney, Agent, or Firm* — Kenealy Vaidya LLP

(57) ABSTRACT

An electric wire with a crimp terminal which can improve a connection stability between a crimp terminal and the electric wire without making a fixing work of the crimp terminal troublesome is provided. In an electric wire with a crimp terminal in which an outer peripheral surface of a conductor portion into which a plurality of metal element wires is bundled together is covered with an insulating sheath portion into an electric wire, and the conductor portion of a terminal portion of the electric wire is exposed, and a conductor crimping portion of the crimp terminal is crimped onto the exposed conductor portion, the terminal surfaces of the plurality of metal element wires are cut in alignments so that the metal element lines extend more as the metal element lines are farther from one side portion side of the exposed conductor portion in a radial direction.

2 Claims, 20 Drawing Sheets

(56) References Cited

U.S. PATENT DOCUMENTS

| | | | | |
|---|---|---|---|---|
| 6,830,479 | B2 * | 12/2004 | Holliday | H01R 9/0518 439/578 |
| 7,048,551 | B2 * | 5/2006 | Takayama | H01R 4/185 439/851 |
| 8,118,612 | B2 | 2/2012 | Morikawa | |
| 2006/0102375 | A1 | 5/2006 | Tamm | |
| 2009/0269970 | A1 * | 10/2009 | Kumakura | H01R 43/0486 439/421 |
| 2010/0035482 | A1 | 2/2010 | Nakamura et al. | |
| 2011/0065316 | A1 | 3/2011 | Morikawa | |

FOREIGN PATENT DOCUMENTS

| | | | |
|---|---|---|---|
| JP | 2003-338349 | A | 11/2003 |
| JP | 2005-116236 | A | 4/2005 |
| JP | 2009-54461 | A | 3/2009 |
| JP | 2010-61871 | A | 3/2010 |
| JP | 2010-140707 | A | 6/2010 |

OTHER PUBLICATIONS

Chinese Office Action and Search Report for the related Chinese Patent Application No. 201310085521.7 dated Aug. 25, 2015.

Chinese Office Action for the related Chinese Patent Application No. 201310085521.7 dated Dec. 22, 2015.

Japanese Office Action for the related Japanese Patent Application No. 2012-060302 dated Jan. 12, 2016.

Japanese Office Action for the related Japanese Patent Application No. 2012-060302 dated Nov. 4, 2015.

* cited by examiner

ELECTRIC WIRE WITH CRIMP TERMINAL

This application claims the priority benefit under 35 U.S.C. §120 and is a Continuation of co-pending U.S. patent application Ser. No. 13/832,361 filed on Mar. 15, 2013 and claims the priority benefit under 35 U.S.C. §119 of Japanese Patent Application No. 2012-060302 filed on Mar. 16, 2012, which applications are hereby incorporated in their entirety by reference.

TECHNICAL FIELD

The present invention relates to an electric wire with a crimp terminal in which a crimp terminal is crimped onto a conductor portion.

BACKGROUND ART

Up to now, an electric wire having a terminal fitting connected to a terminal portion, there is an electric wire with a crimp terminal in which an outer peripheral surface of a conductor portion having a plurality of metal element wires bundled together is coated with an insulating sheath portion into the electric wire, the conductor portion of the terminal portion of the electric wire is exposed, and a conductor crimping portion of the crimp terminal is crimped onto the conductor portion of the exposed conductor portion. The electric wire with the crimp terminal of this type makes it difficult to connect the metal element wires arranged inside of the conductor portion in a radial direction to the crimp terminal. Therefore, for example, Patent Document 1 has proposed a connection structure of the crimp terminal and the electric wire in which the metal element wires arranged inside of the conductor portion in the radial direction are also connected with the crimp terminal.

In the connection structure of the crimp terminal and the electric wire disclosed in Patent Document 1, a plurality of metal element wires is cut in alignments so as to be stepped along a circumferential direction of the conductor portion, to thereby connect the metal element wires inside of the conductor portion in the radial direction to the crimp terminal.

CITATION LIST

Patent Document

[Patent Document 1] JP-A-2005-116236

SUMMARY OF INVENTION

Technical Problem

However, there arises such a problem that a work of cutting the metal element wires in alignments along the circumferential direction in the connection structure of the crimp terminal and the electric wire disclosed in Patent Document 1 is troublesome.

The present invention has been made in view of the above circumstances, and therefore an object of the present invention is to provide an electric wire with a crimp terminal which can improve a connection stability between the crimp terminal and the electric wire without making a fitting work of the crimp terminal troublesome.

Solution to Problem

According to the first aspect of the present invention, there is provided an electric wire with a crimp terminal, including a conductor portion, an outer peripheral surface of the conductor portion into which a plurality of metal element wires is bundled together being covered with an insulating sheath portion into the electric wire, and the conductor portion of a terminal portion of the electric wire being exposed, and a conductor crimping portion of the crimp terminal that is crimped onto the exposed conductor portion, wherein terminal surfaces of the plurality of metal element wires are cut in alignments so that the metal element lines extend more as the metal element lines are farther from one side portion side of the exposed conductor portion in a radial direction.

According to the second aspect of the present invention, in the electric wire with a crimp terminal, the terminal surfaces of the plurality of metal element wires may be cut in alignments so that steps are formed on the one side portion side of the exposed conductor portion According to the third aspect of the present invention, in the electric wire with a crimp terminal, the terminal surfaces of the plurality of metal element wires may be cut in alignments so that the exposed conductor portion is formed with an inclined end surface which is an end surface inclined with respect to an extension direction.

According to the fourth aspect of the present invention, there is provided an electric wire with a crimp terminal, including a conductor portion, an outer peripheral surface of the conductor portion into which a plurality of metal element wires is bundled together being covered with an insulating sheath portion into the electric wire, and the conductor portion of a terminal portion of the electric wire being exposed, and a conductor crimping portion of the crimp terminal that is crimped onto the exposed conductor portion, wherein the exposed conductor portion has an outside element wire folded portion configured such that the plurality of metal element wires arranged in the circumferential direction, outside in the radial direction is folded back in a direction opposite to the end surface of the conductor portion along the extension direction

Advantageous Effects of the Invention

In the electric wire with the crimp terminal according to the first aspect of the present invention, the terminal surfaces of the plurality of metal element wires are cut in alignments so that the metal element lines extend more as the metal element lines are farther from one side portion side of the exposed conductor portion in a radial direction. With this configuration, a part of the metal element wires arranged inside of the conductor portion in the radial direction is exposed, to thereby be connected to the crimp terminal, and also the plurality of metal element wires can be cut to be aligned from the one side portion side of the conductor portion. As a result, the connection stability of the crimp terminal and the electric wire can be improved without making the fixing work of the crimp terminal troublesome.

In the electric wire with the crimp terminal according to the second aspect of the present invention, the terminal surfaces of the plurality of metal element wires are cut in alignments so that the steps are formed on the one side portion side of the exposed conductor portion. With this configuration, a part of the metal element wires arranged inside in the radial direction can be exposed in the stepped portions, and connected to the crimp terminal.

In the electric wire with the crimp terminal according to the third aspect of the present invention, the terminal surfaces of the plurality of metal element wires are cut in alignments so that the exposed conductor portion is formed with the inclined end surface which is the end surface inclined with respect to the extension direction. With this configuration, a part of the metal element wires arranged inside in the radial direction can be exposed in the inclined ends surface, and connected to the crimp terminal.

In the electric wire with the crimp terminal according to the fourth aspect of the present invention, the exposed conductor portion has the outside element wire folded portion configured such that the plurality of metal element wires arranged in the circumferential direction, outside in the radial direction is folded back in a direction opposite to the end surface of the conductor portion along the extension direction. With this configuration, the plurality of metal element wires is bent without being cut in alignment, to thereby easily expose the metal element wires arranged inside of the conductor portion in the radial direction. As a result, the connection stability of the crimp terminal and the electric wire can be improved without making the fixing work of the crimp terminal troublesome.

DESCRIPTION OF EMBODIMENTS

Hereinafter, an electric wire with a crimp terminal according to preferred embodiments of the present invention will be described in detail with reference to the drawings.

First Embodiment

Figure 1:
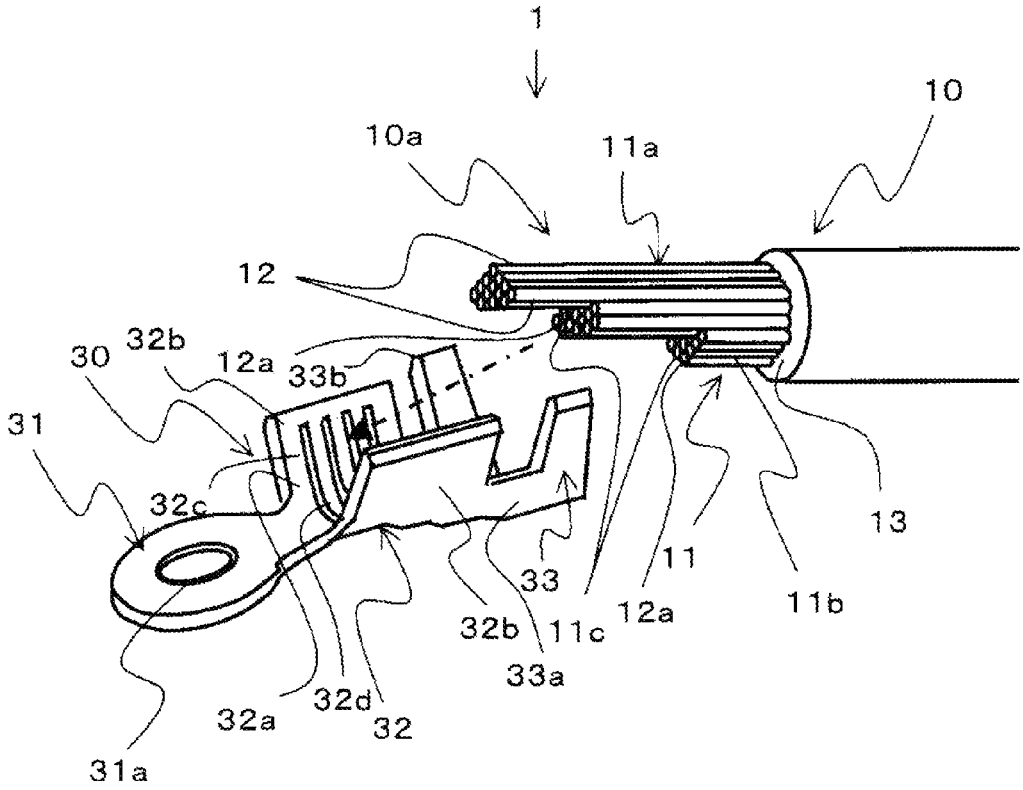
FIG. 1 is an exploded perspective view of an electric wire with a crimp terminal according to a first embodiment of the present invention.
Figure 2:
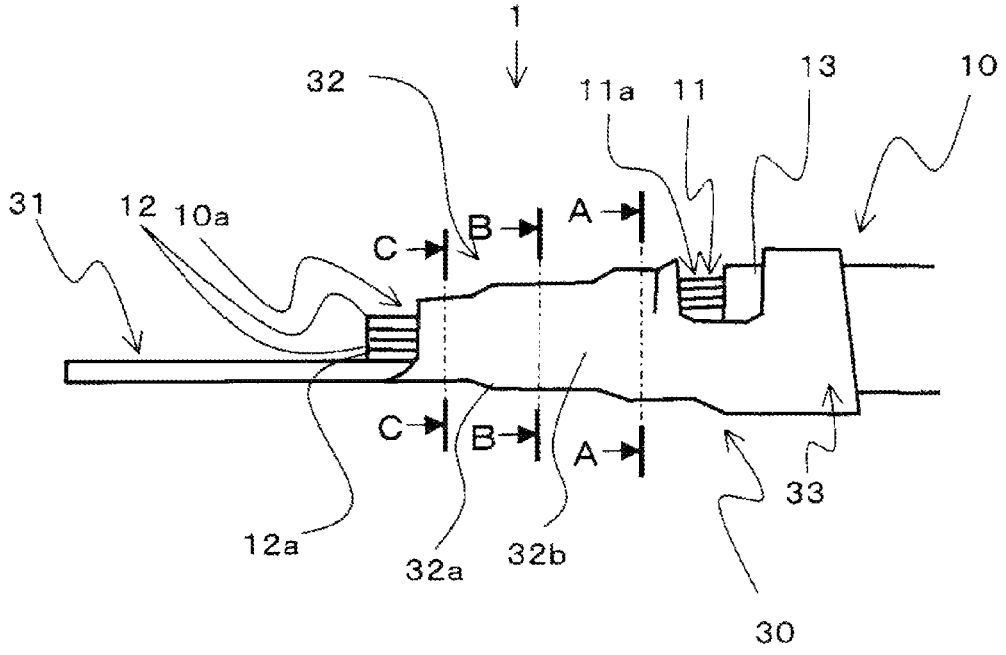
FIG. 2 is a side view of the electric wire with a crimp terminal illustrated in FIG. 1.
Figure 3:
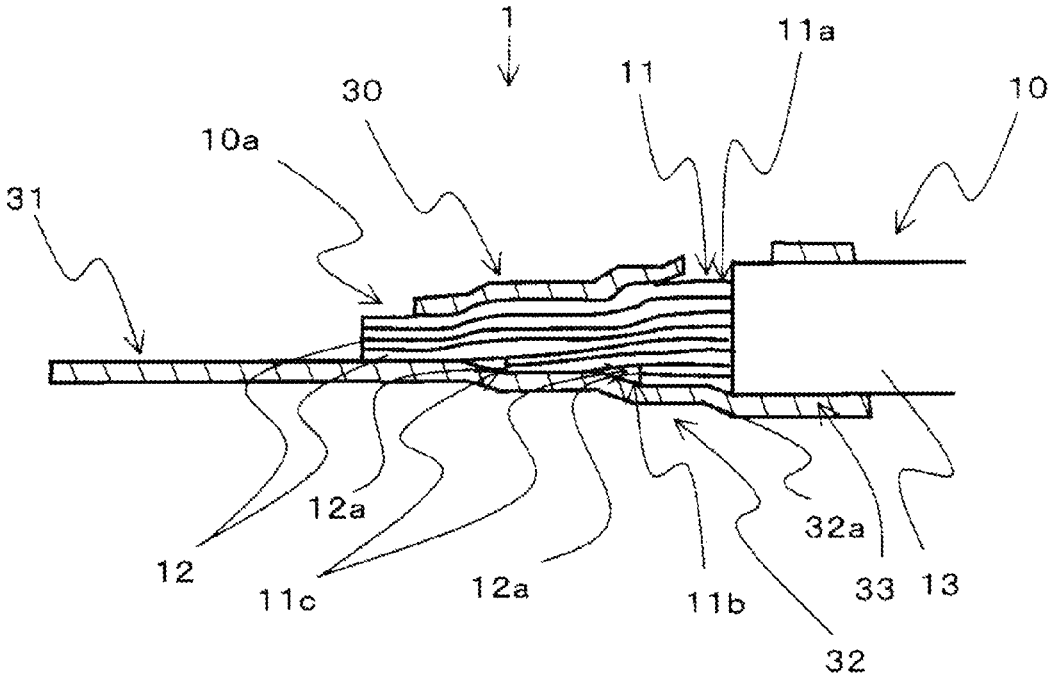
FIG. 3 is a partially cross-sectional view of the electric wire with a crimp terminal illustrated in FIG. 1.
Figure 4:
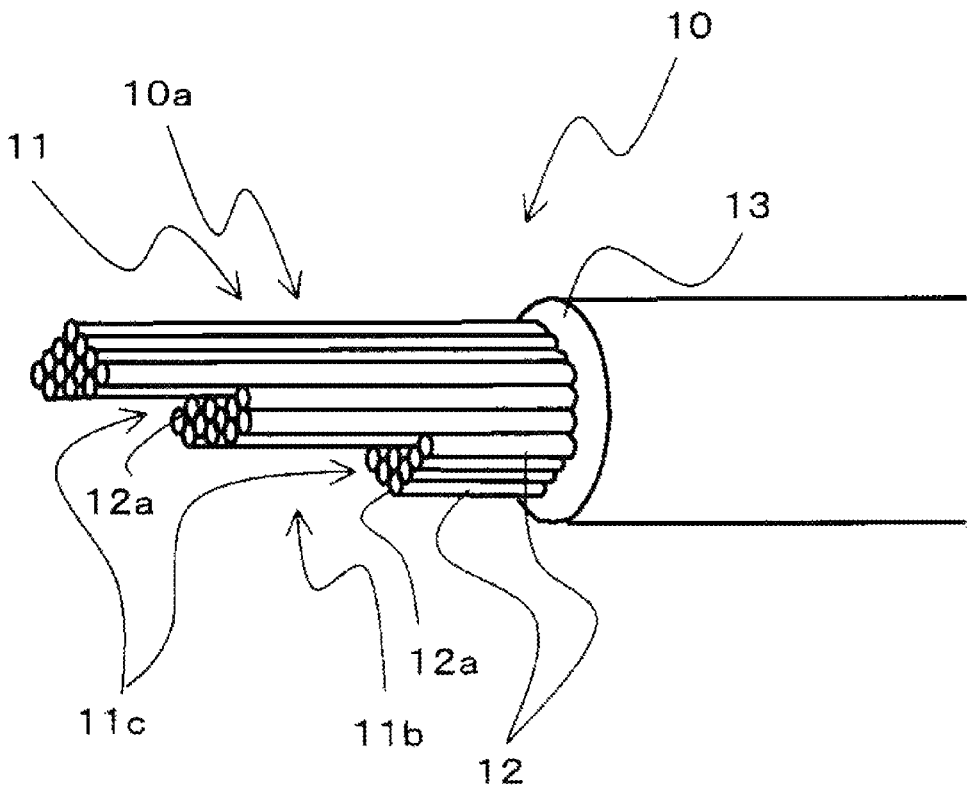
FIG. 4 is an enlarged perspective view of the electric wire illustrated in FIG. 1.
Figure 5:
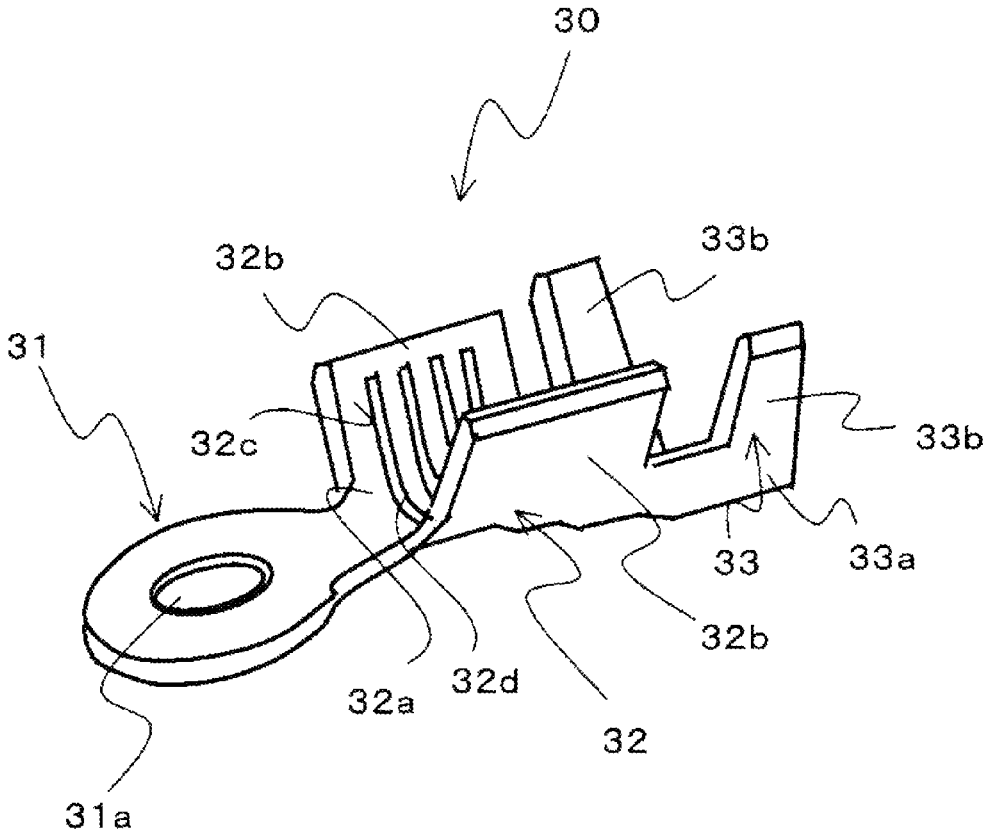
FIG. 5 is an enlarged perspective view of the crimp terminal illustrated in FIG. 1.
Figure 7:
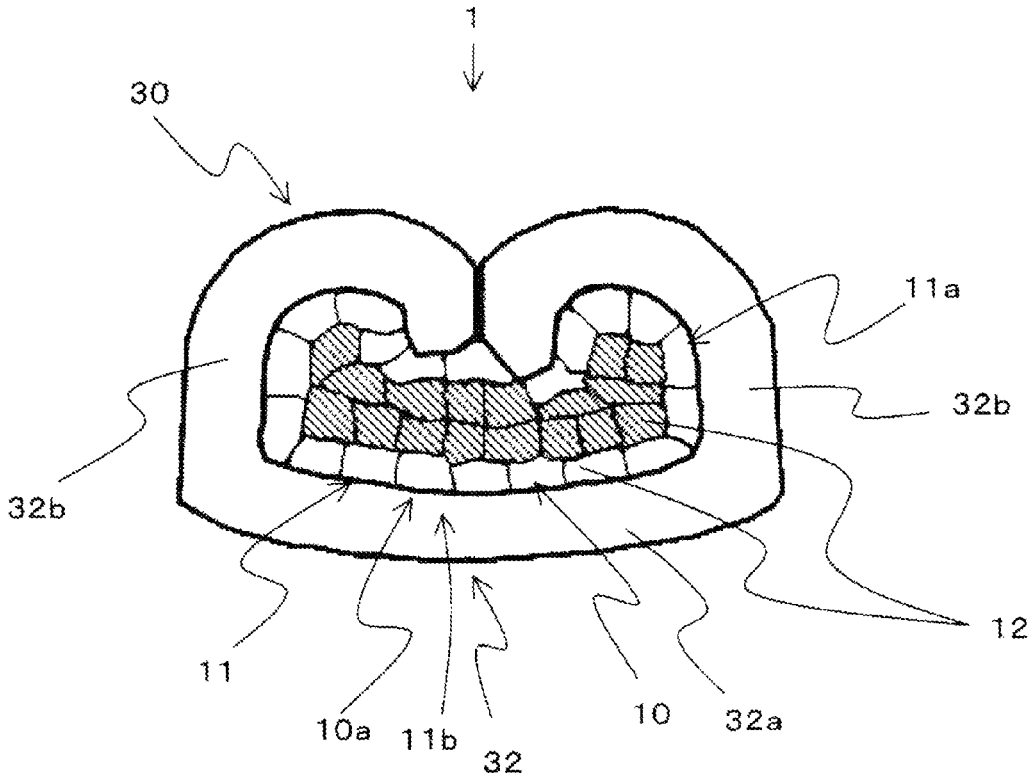
FIG. 7 is a cross-sectional view taken along a line A-A of the electric wire with a crimp terminal illustrated in FIG. 2.
Figure 8:
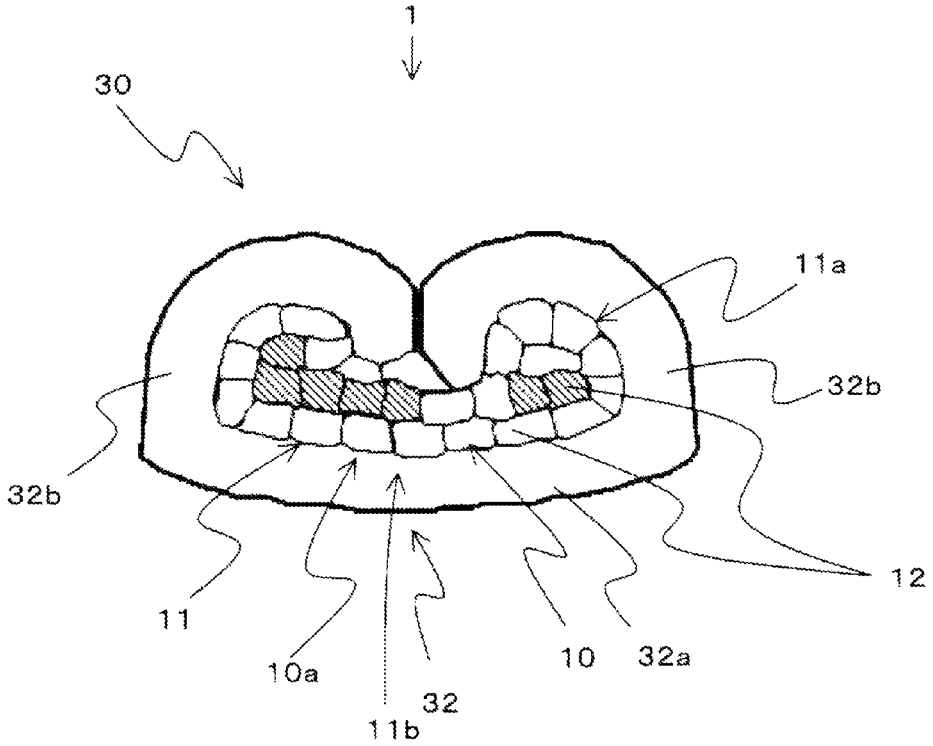
FIG. 8 is a cross-sectional view taken along a line B-B of the electric wire with a crimp terminal illustrated in FIG. 2.
Figure 9:
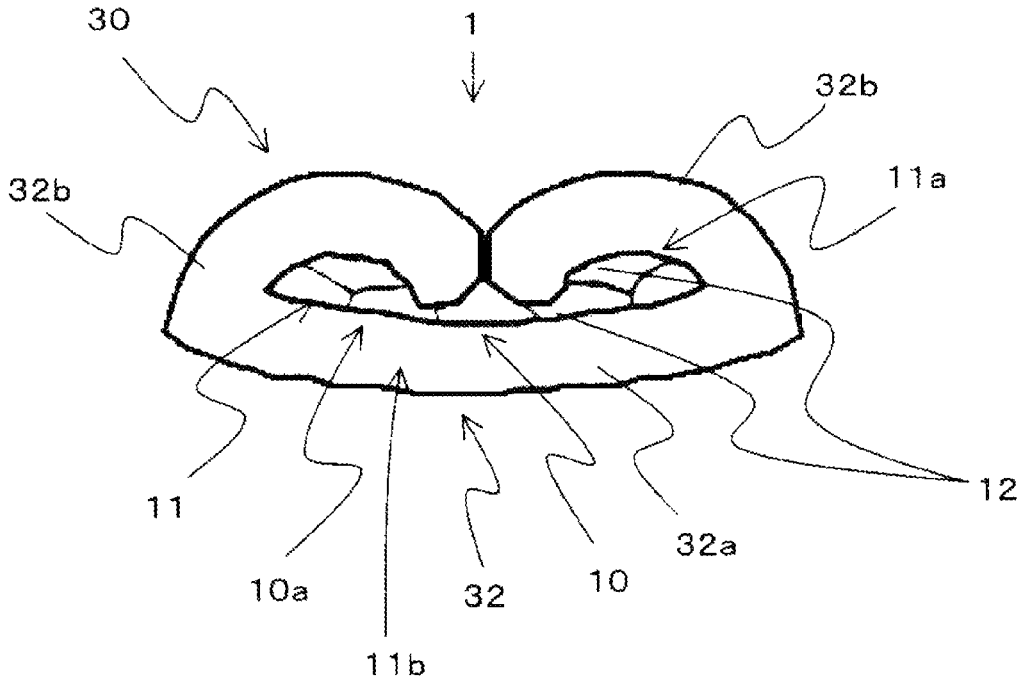
FIG. 9 is a cross-sectional view taken along a line C-C of the electric wire with a crimp terminal illustrated in FIG. 2.

FIG. 1 is an exploded perspective view of an electric wire 1 with a crimp terminal according to a first embodiment of the present invention. FIG. 2 is a side view of the electric wire 1 with the crimp terminal illustrated in FIG. 1. FIG. 3 is a partially cross-sectional view of the electric wire 1 with the crimp terminal illustrated in FIG. 1. FIG. 4 is an enlarged perspective view of the electric wire 10 illustrated in FIG. 1. FIG. 5 is an enlarged perspective view of a crimp terminal 30 illustrated in FIG. 1. FIGS. 6A to 6D are diagram illustrating a modified example of the crimp terminal 30 illustrated in FIG. 1. FIG. 7 is a cross-sectional view taken along a line A-A of the electric wire 1 with the crimp terminal illustrated in FIG. 2. FIG. 8 is a cross-sectional view taken along a line B-B of the electric wire 1 with the crimp terminal illustrated in FIG. 2. FIG. 9 is a cross-sectional view taken along a line C-C of the electric wire 1 with the crimp terminal illustrated in FIG. 2.

In FIGS. 7 to 9, cross-sections of metal element wires 12 connected to the crimp terminal 30 are outlined.

In the electric wire 1 with the crimp terminal according to the first embodiment of the present invention, an outer peripheral surface 11*a* of a conductor portion 11 in which a plurality of the metal element wires 12 is bundled together is covered with an insulating sheath portion 13 into the electric wire 10, and the conductor portion 11 of a terminal portion 10*a* of the electric wire 10 is exposed, and a conductor crimping portion 32 of the crimp terminal 30 is crimped onto the exposed conductor portion 11.

First, the electric wire 10 will be described.

The electric wire 10 is configured such that the conductor portion 11 in which the plurality of metal element wires 12 is bundled together is covered with the insulating sheath portion 13.

The metal element wires 12 are made of, for example, an aluminum material, and the plurality of metal element wires 12 is bundled together to function as the conductor portion.

Terminal surfaces 12*a* of the plural metal element wires 12 are cut in alignments so that the metal element wires 12 extend more as the exposed conductor portion 11 is farther from one side portion 11*b* side in a radial direction. More specifically, in the exposed conductor portion 11, the terminal surfaces 12*a* of the plural metal element wires 12 are cut in alignments so that two steps 11*c* are formed on the one side portion 11*b* side. In the metal element wires 12 thus cut in alignments, as illustrated in FIG. 4, a part of the metal element wires 12 arranged inside in the radial direction is exposed. For that reason, the exposed portion is connected to the crimp terminal 30 as illustrated in FIGS. 8 and 9.

The insulating sheath portion 13 is made of an insulating material such as synthetic resin, and is so formed as to cover the outer peripheral surface 11*a* of the conductor portion 11, to thereby insulatably protect the conductor portion 11.

In the electric wire 10, the insulating sheath portion 13 of the terminal portion 10*a* of the electric wire 10 is removed, and the crimp terminal 30 is connected to the exposed conductor portion 11.

Subsequently, the crimp terminal 30 will be described.

The crimp terminal 30 is fabricated by subjecting a plane member made of, for example, copper alloy, which will be described later, to die cutting by a die press to form die cut members of the plural crimp terminals 30, and then subjecting each of the die cut members to bending.

The crimp terminal 30 includes a partner connection portion 31 which is a connection portion with a connection partner not shown, a conductor crimping portion 32 that is crimped onto the exposed conductor portion 11, and an insulating sheath crimping portion 33 that is crimped onto the insulating sheath portion 13 of the electric wire 10.

The partner connection portion 31 is formed with a circular through-hole 31*a* roughly in the center of a flat plate having an outer circular shape. The partner connection portion 31 is fixed to the connection partner not shown by inserting a fixing member such as a bolt through the through-hole 31*a*.

The conductor crimping portion 32 is a portion that is formed between the partner connection portion 31 and the insulating sheath crimping portion 33 where the crimp terminal 30 and the conductor portion 11 are connected to each other. The conductor crimping portion 32 includes a bottom portion 32*a* with a wall forming a bottom surface, and a pair of crimp flake portions 32*b* where both edges of the bottom portion 32*a* are erected in flake shapes. The pair of crimp flake portions 32*b* is bent inward with the use of a crimp jig so as to be crimped onto the conductor portion 11.

Also, the conductor crimping portion 32 has a crimp side surface 32*c* formed with a plurality of grooves 32*d*. The grooves 32*d* are called "serration", and have a function of increasing a contact area with the conductor portion 11, or improving a retention force of the conductor portion 11 by the conductor crimping portion 32.

This embodiment exemplifies that the grooves 32*d* are formed in the conductor crimping portion 32. Alternatively, the conductor crimping portion 32 may not have the grooves 32*d*.

Also, as illustrated in FIG. 5, in the conductor crimping portion 32, the bottom portion 32*a* is stepped in correspondence with the steps 11*c* of the conductor portion 11. For that reason, the conductor crimping portion 32 is crimped onto the conductor portion 11 so as to follow the steps 11*c* formed in the one side portion 11*b* side of the conductor portion 11.

The conductor crimping portion 32 is configured to easily follow the conductor portion 11 by stepping the bottom portion 32*a*. However, the present invention is not limited to this configuration. That is, the bottom portion 32*a* may not be stepped (refer to FIG. 6A).

Figure 6A:
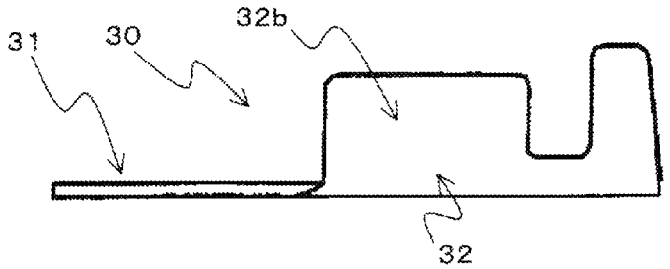
FIGS. 6A to 6D are diagrams illustrating a modified example of the crimp terminal illustrated in FIG. 1.
Figure 6B:
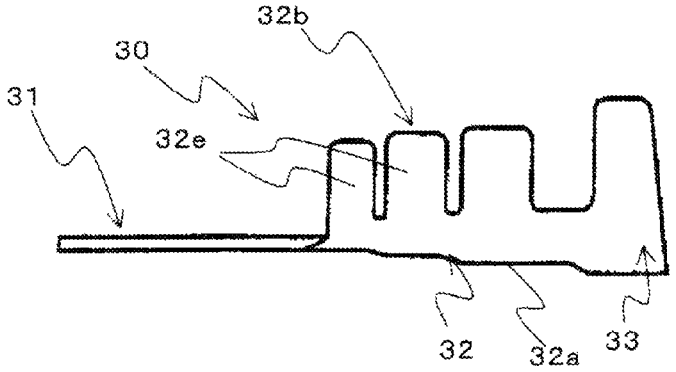

Alternatively, the bottom portion 32*a* may be stepped, and each of the pair of crimp flake portions 32*b* may be notched and divided into three pieces so that each of the pair of crimp flake portions 32*b* easily follows the steps 11*c* of the conductor portion 11, and the height of respective divided pieces 32*e* may be increased from a front end of the crimp flake portions 32*b* toward a rear end thereof in a stepwise fashion (refer to FIG. 6B).

Figure 6C:
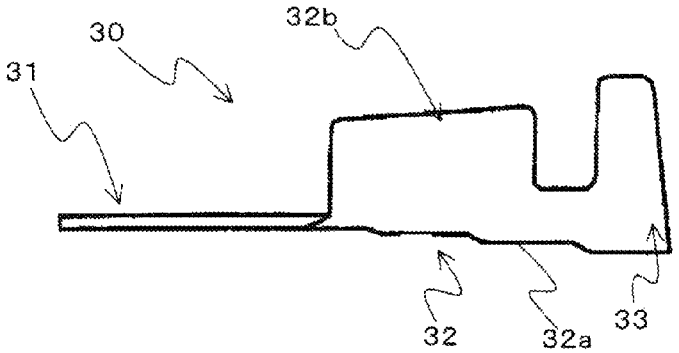

Alternatively, the bottom portion 32*a* may be stepped, and each edge surface of the pair of crimp flake portions 32*b* may be inclined so that the height of the edge surface gradually increases from the front end toward the rear end (refer to FIG. 6C).

Figure 6D:
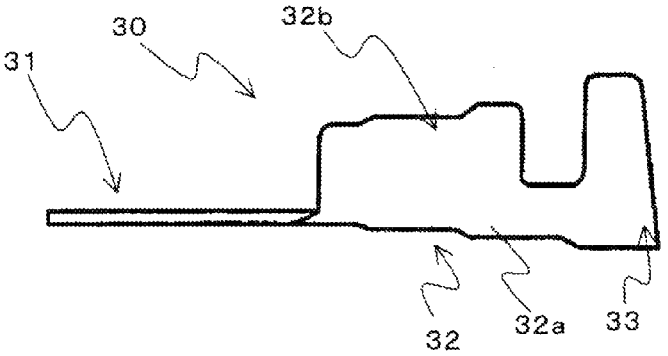

Alternatively, the bottom portion 32*a* and each edge surface of the pair of crimp flake portions 32*b* may be stepped (refer to FIG. 6D).

The insulating sheath crimping portion 33 is a portion in which the insulating sheath crimping portion 33 forms an end opposite to the partner connection portion 31 of the crimp terminal 30, and crimped onto the insulating sheath portion 13 to hold the electric wire 10. The insulating sheath crimping portion 33 includes a bottom portion 33*a* common with the bottom portion 32*a* of the conductor crimping portion 32, and a pair of crimp flake portions 33*b* obtained by erecting both edges of the bottom portion 33*a*. The pair of crimp flake portions 33*b* is bent inward with the use of a crimp jig not shown so as to be crimped onto the insulating sheath portion 13.

Subsequently, a description will be given of a procedure of crimping the crimp terminal 30 of the electric wire 1 with the crimp terminal onto the electric wire 10 according to the first embodiment of the present invention with reference to FIGS. 10A to 10D. FIGS. 10A to 10D are diagrams illustrating a procedure of crimping the crimp terminal 30 of the electric wire 1 with the crimp terminal onto the electric wire 10.

Figure 10A:
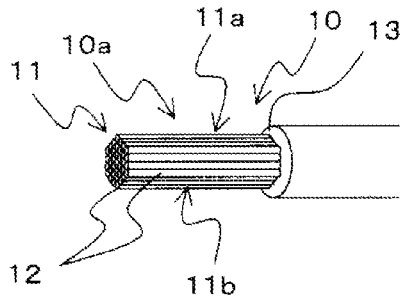
FIGS. 10A to 10D are diagrams illustrating a procedure of crimping the crimp terminal of the electric wire with a crimp terminal onto the electric wire.

First, a worker peels off the insulating sheath portion 13 of the terminal portion 10*a* of the electric wire 10 to expose the conductor portion 11 (refer to FIG. 10A).

Figure 10B:
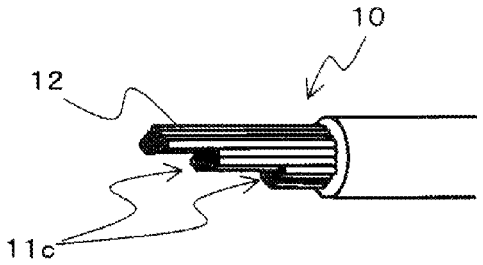

Thereafter, the worker cuts the terminal surfaces 12*a* of the plural metal element wires 12 in alignments so that two steps 11*c* are formed on the one side portion 11*b* side of the exposed conductor portion 11 (refer to FIG. 10B). In this situation, since the worker can cut the plurality of metal element wires 12 in alignments from the one side portion 11*b* side of the conductor portion 11, the plurality of metal element wires 12 is easily cut in alignments in a stepped fashion without conducting a troublesome work.

Figure 10C:
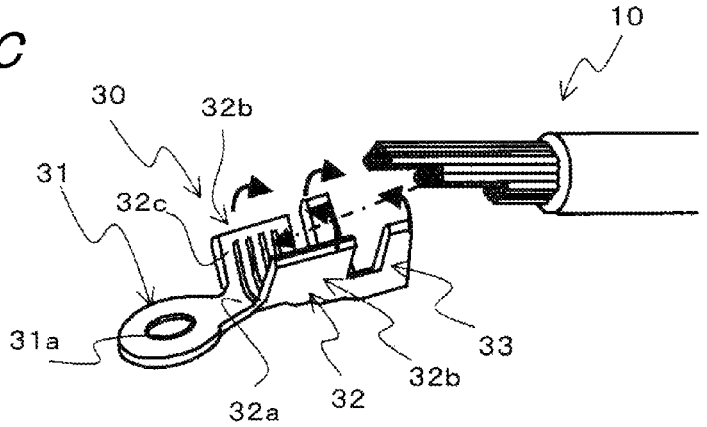
Figure 10D:
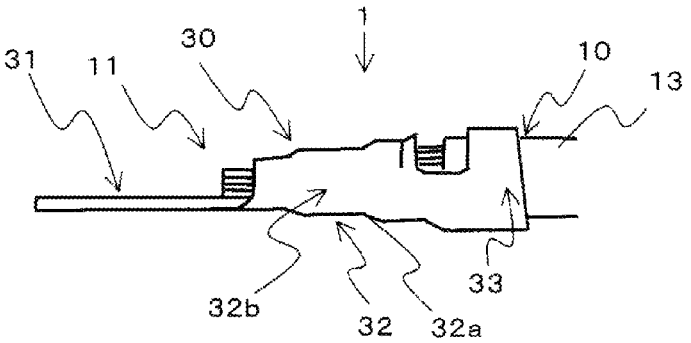

Thereafter, the worker crimps the crimp terminal 30 onto the electric wire 10 with the use of the crimp jig not shown to complete the work (refer to FIGS. 10C and 10D). As a result, the conductor crimping portion 32 is crimped to the stepped conductor portion 11, and not only the metal element wires 12 arranged outside in the radial direction are connected to the conductor portion 11, but also a part of the metal element wires 12 arranged inside in the radial direction is connected to the crimp terminal 30.

In the electric wire 1 with the crimp terminal according to the first embodiment of the present invention, the terminal surfaces 12*a* of the plural metal element wires 12 are cut in alignments so that the metal element wires 12 extend more as the exposed conductor portion 11 is farther from one side portion 11*b* side in the radial direction. Therefore, a part of the metal element wires 12 arranged inside of the conductor portion 11 in the radial direction is exposed, to thereby be connected to the crimp terminal 30. Moreover, since the plurality of metal element wires 12 can be cut in alignments from the one side portion 11*b* side of the conductor portion 11, the connection stability of the crimp terminal 30 and the electric wire 10 can be resultantly improved without making the fixing work of the crimp terminal 30 troublesome.

Also, in the electric wire 1 with the crimp terminal according to the first embodiment of the present invention, the terminal surfaces 12*a* of the plural metal element wires 12 are cut in alignments so that the steps 11*c* are formed on the one side portion 11*b* side of the exposed conductor portion 11. As a result, a part of the metal element wires 12 arranged inside in the radial direction is exposed in a portion where the steps 11*c* are formed, and can be connected to the crimp terminal 30.

In the electric wire 1 with the crimp terminal according to the first embodiment of the present invention, the terminal surfaces 12*a* of the plural metal element wires 12 are cut in alignments so that the two steps 11*c* are formed on the one side portion 11*b* side of the exposed conductor portion 11. However, the present invention is not limited to this configuration, but one or more steps 11*c* may be formed.

Modified Example

Figure 11:
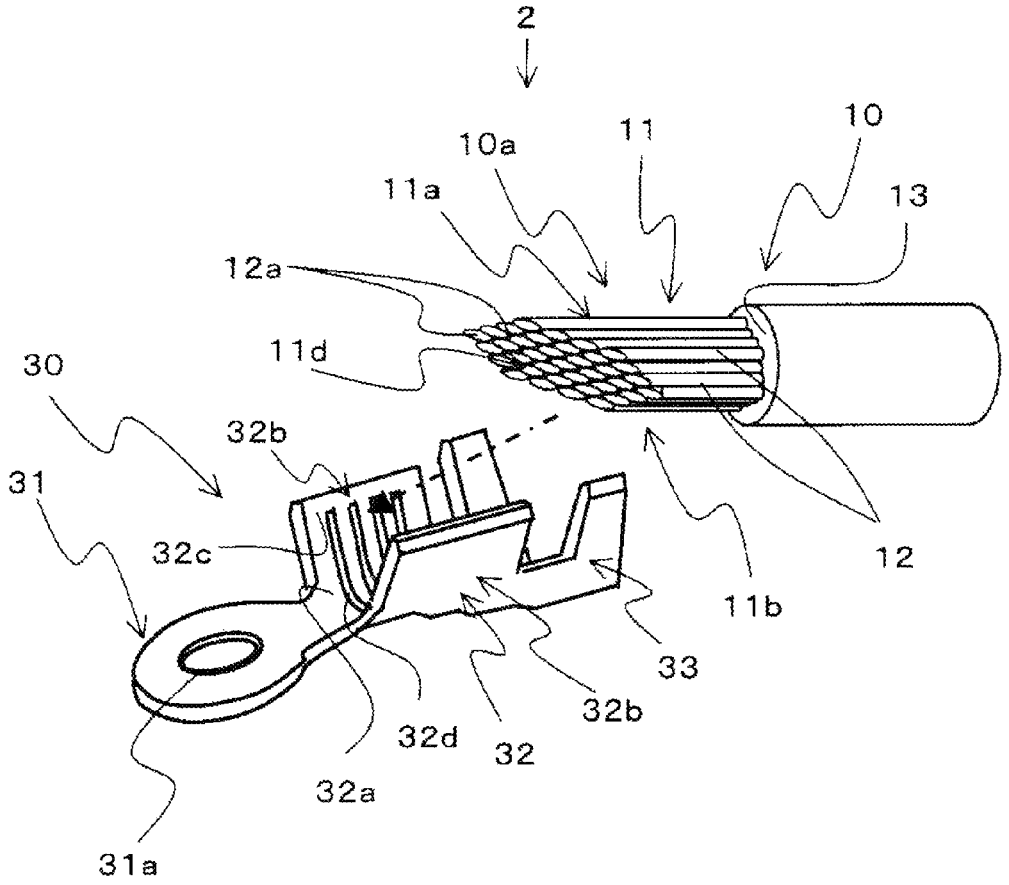
FIG. 11 is an exploded perspective view of the electric wire with a crimp terminal according to a modified example according to the first embodiment of the present invention.
Figure 12:
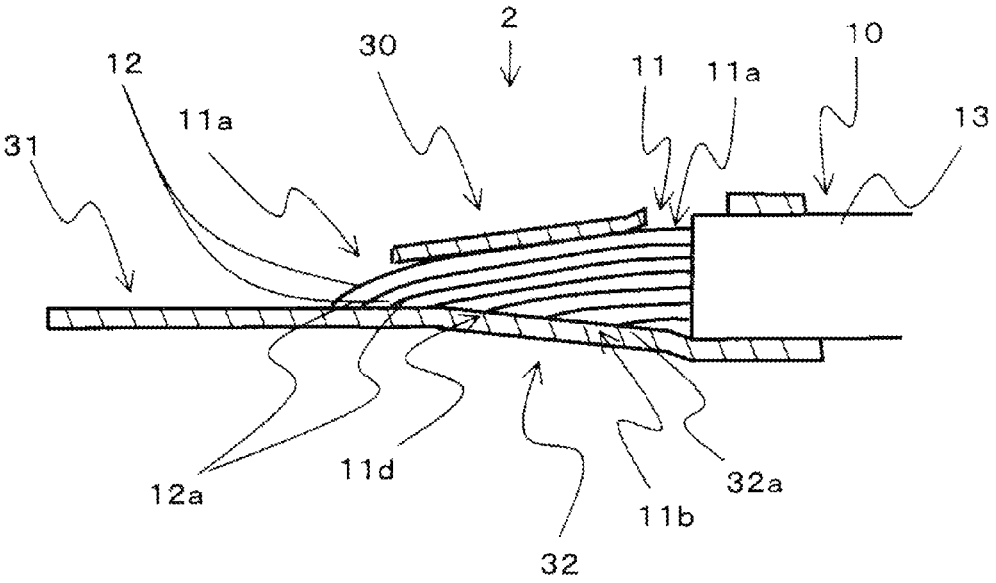
FIG. 12 is a partially cross-sectional view of the electric wire with a crimp terminal illustrated in FIG. 11.

Subsequently, a description will be given of an electric wire 2 with a crimp terminal which is a modified example of the electric wire 1 with the crimp terminal according to the first embodiment of the present invention, with reference to FIGS. 11 and 12. FIG. 11 is an exploded perspective view of the electric wire 2 with the crimp terminal according to a modified example according to the first embodiment of the present invention. FIG. 12 is a partially cross-sectional view of the electric wire 2 with the crimp terminal illustrated in FIG. 11.

The electric wire 2 with the crimp terminal according to this modified example is different from the electric wire 1 with the crimp terminal according to the first embodiment in that the plurality of metal element wires 12 is cut to be aligned along an inclined plane.

Other configurations are identical with those in the first embodiment, and the same configuration portions as those in the first embodiment are denoted by identical symbols.

In the electric wire 2 with the crimp terminal according to this modified example, the terminal surfaces 12*a* of the plural metal element wires 12 are cut in alignment so that the conductor portion 11 exposed from the insulating sheath portion 13 is formed with an inclined end surface 11*d* which is an end surface inclined with respect to an extension direction of the conductor portion 11. For that reason, the terminal surfaces 12*a* of the respective metal element wires 12 face the one side portion 11*b* side, to thereby connect to the crimp terminal 30 as illustrated in FIG. 9.

As a procedure of crimping the crimp terminal 30 in the electric wire 2 with the crimp terminal onto the electric wire 10, the worker cuts the plurality of metal element wires 12 to be aligned in an oblique direction from the one side portion 11*b* side of the conductor portion 11, to thereby form the inclined end surface 11*d*.

As with the electric wire 1 with the crimp terminal according to the first embodiment, in the electric wire 2 with the crimp terminal according to this modified example, the terminal surfaces 12*a* of the plural metal element wires 12 are cut in alignment so that the metal element wires 12 extend more as the exposed conductor portion 11 is farther from the one side portion 11*b* side in the radial direction. Therefore, a part of the metal element wires 12 arranged inside of the conductor portion 11 in the radial direction is exposed, to thereby be connected to the crimp terminal 30. Moreover, since the plurality of metal element wires 12 can be cut to be aligned from the one side portion 11*b* side of the conductor portion 11, the connection stability of the crimp terminal 30 and the electric wire 10 can be resultantly improved without making the fixing work of the crimp terminal 30 troublesome.

Also, in the electric wire 2 with the crimp terminal according to this modified example, the terminal surfaces 12*a* of the plural metal element wires 12 are cut in alignment so that the exposed conductor portion 11 is formed with an inclined end surface 11*d* which is an end surface inclined with respect to an extension direction of the conductor portion 11. Therefore, a part of the metal element wires 12 arranged inside in the radial direction can be exposed by the inclined end surface 11*d*, and connected to the crimp terminal 30.

Second Embodiment

Figure 13:
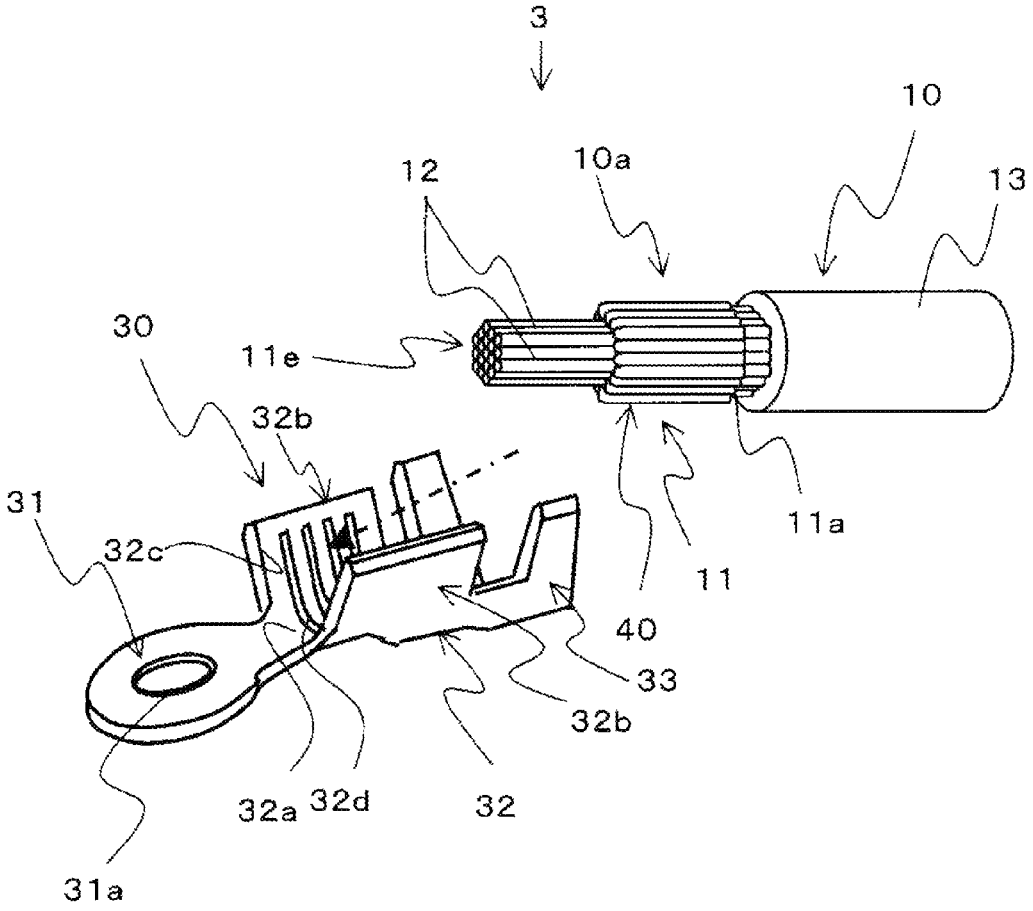
FIG. 13 is an exploded perspective view of an electric wire with a crimp terminal according to a second embodiment of the present invention.
Figure 14:
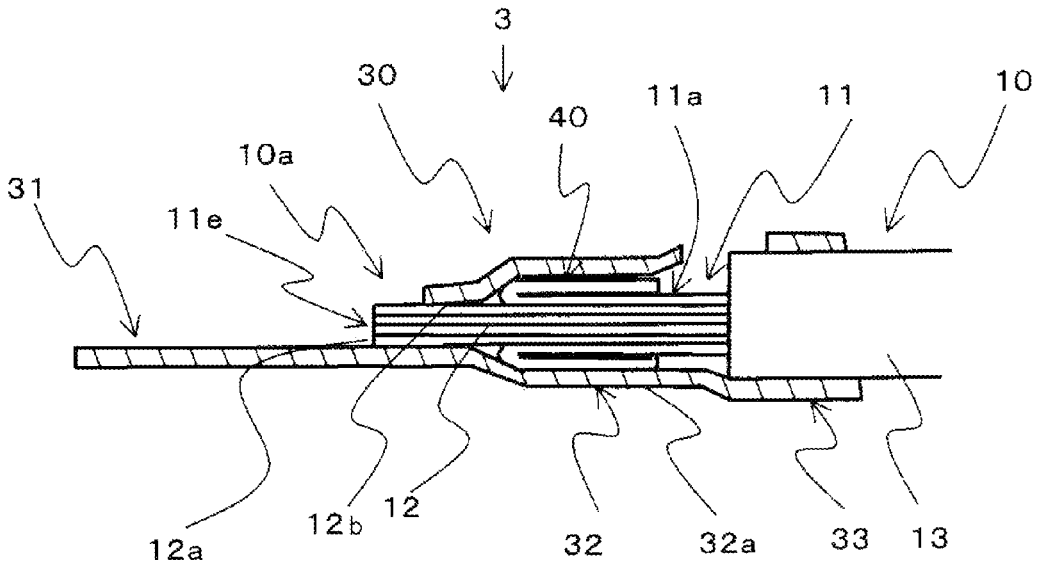
FIG. 14 is a partially cross-sectional view of the electric wire with a crimp terminal illustrated in FIG. 13.
Figure 15:
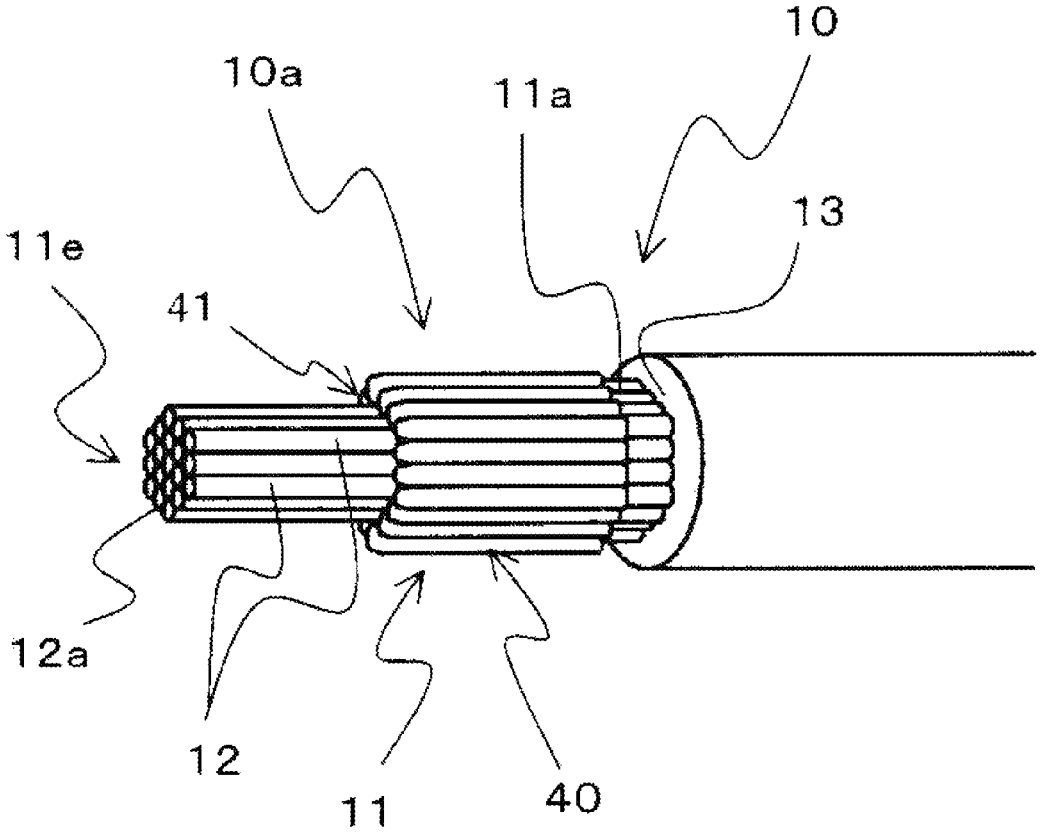
FIG. 15 is an enlarged perspective view of the electric wire illustrated in FIG. 13.
Figure 16:
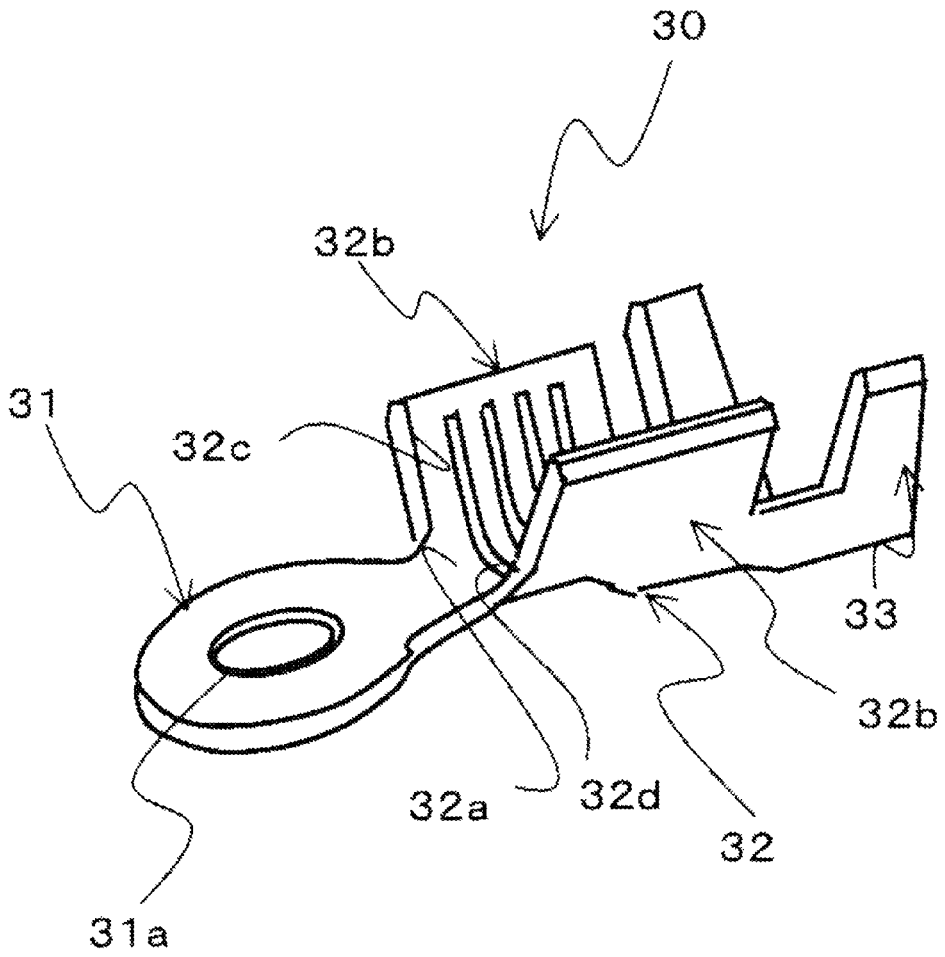
FIG. 16 is an enlarged perspective view of the crimp terminal illustrated in FIG. 13.

Subsequently, a description will be given of an electric wire 3 with a crimp terminal according to a second embodiment of the present invention with reference to FIGS. 13 to 17D. FIG. 13 is an exploded perspective view of the electric wire 3 with a crimp terminal according to the second embodiment of the present invention. FIG. 14 is a partially cross-sectional view of the electric wire 3 with a crimp terminal illustrated in FIG. 13. FIG. 15 is an enlarged perspective view of the electric wire 10 illustrated in FIG. 13. FIG. 16 is an enlarged perspective view of the crimp terminal 30 illustrated in FIG. 13. FIGS. 17A to 17D are diagrams illustrating a modified example of the crimp terminal 30 illustrated in FIG. 13.

The electric wire 3 with the crimp terminal according to the second embodiment is different from the electric wire 1 with the crimp terminal according to the first embodiment in that not the plurality of metal element wires 12 is cut in alignments in the stepped fashion, but the plurality of metal element wires 12 arranged in a circumferential direction, outside in the radial direction are folded back.

Other configurations are identical with those in the first embodiment, and the same configuration portions as those in the first embodiment are denoted by identical symbols.

In the electric wire 3 with the crimp terminal according to the second embodiment of the present invention, an outer peripheral surface 11*a* of a conductor portion 11 in which a plurality of the metal element wires 12 is bundled together is covered with an insulating sheath portion 13 into the electric wire 10, and the conductor portion 11 of a terminal portion 10*a* of the electric wire 10 is exposed, and a conductor crimping portion 32 of the crimp terminal 30 is crimped onto the exposed conductor portion 11.

First, the electric wire 10 will be described.

The electric wire 10 is configured such that the conductor portion 11 in which the plurality of metal element wires 12 is bundled together is covered with the insulating sheath portion 13.

The metal element wires 12 are made of, for example, an aluminum material, and the plurality of metal element wires 12 is bundled together to function as the conductor portion.

The exposed conductor portion 11 has an outside element wire folded portion 40. The outside element wire folded portion 40 is configured such that the plurality of metal element wires 12 (hereinafter referred to as "radial outside element wire group") arranged in the circumferential direction, outside in the radial direction is folded back in a direction opposite to an end surface 11*e* of the conductor portion 11 along the extension direction.

In the second embodiment, the radial outside element wire group 12 represents a plurality of metal element wires 12 arranged outermost in the radial direction.

As illustrated in FIG. 15, the metal element wires 12 arranged inside of the conductor portion 11 in the radial direction are exposed by the outside element wire folded portion 40 thus configured. For that reason, as illustrated in FIG. 14, an exposed front end portion 12*b* is connected to the crimp terminal 30.

Also, because a cushioning property of the conductor portion 11 is increased in the outside element wire folded portion 40, an adhesion with the conductor crimping portion 32 which will be described later is improved, and the crimp terminal 30 hardly comes free from the electric wire 10 against an external force such as a tension. Also, the tension is exerted on the outside element wire folded portion 40 whereby the tension is hardly exerted on a small-diameter front end side of the conductor portion 11 as compared with the outside element wire folded portion 40.

The insulating sheath portion 13 is made of an insulating material such as synthetic resin, and is so formed as to cover the outer peripheral surface of the conductor portion 11, to thereby insulatably protect the conductor portion 11.

In the electric wire 10, the insulating sheath portion 13 of the terminal portion 10*a* of the electric wire 10 is removed, and the crimp terminal 30 is connected to the exposed conductor portion 11.

Subsequently, the crimp terminal 30 will be described.

The crimp terminal 30 is fabricated by subjecting a plane member made of, for example, copper alloy, which will be described later, to die cutting by a die press to form die cut members of the plural crimp terminals 30, and then subjecting each of the die cut members to bending.

The crimp terminal 30 includes a partner connection portion 31 which is a connection portion with a connection partner not shown, a conductor crimping portion 32 that is crimped onto the exposed conductor portion 11, and an insulating sheath crimping portion 33 that is crimped onto the insulating sheath portion 13 of the electric wire 10.

The partner connection portion 31 is formed with a circular through-hole 31*a* roughly in the center of a flat plate having an outer circular shape. The partner connection portion 31 is fixed to the connection partner not shown by inserting a fixing member such as a bolt through the through-hole 31*a*.

The conductor crimping portion 32 is a portion that is formed between the partner connection portion 31 and the insulating sheath crimping portion 33 where the crimp terminal 30 and the conductor portion 11 are connected to each other. The conductor crimping portion 32 includes a bottom portion 32*a* with a wall forming a bottom surface, and a pair of crimp flake portions 32*b* where both edges of the bottom portion 32*a* are erected in flake shapes. The pair of crimp flake portions 32*b* is bent inward with the use of a crimp jig so as to be crimped onto the conductor portion 11.

Also, the conductor crimping portion 32 has a crimp side surface 32*c* formed with a plurality of grooves 32*d*. The grooves 32*d* are called "serration", and have a function of increasing a contact area with the conductor portion 11, or improving a retention force of the conductor portion 11 by the conductor crimping portion 32.

This embodiment exemplifies that the grooves 32*d* are formed in the conductor crimping portion 32. Alternatively, the conductor crimping portion 32 may not have the grooves 32*d*.

Also, as illustrated in FIG. 16, in the conductor crimping portion 32, the bottom portion 32*a* is stepped in correspondence with the steps 41 of the conductor portion 11. For that reason, the conductor crimping portion 32 is crimped onto the conductor portion 11 so as to follow the steps 41 formed by the outside element wire folded portion 40 of the conductor portion 11.

The conductor crimping portion 32 is configured to easily follow the exposed conductor portion by stepping the bottom portion 32*a*. However, the present invention is not limited to this configuration. That is, the bottom portion 32*a* may not be stepped (refer to FIG. 17A).

Figure 17A:
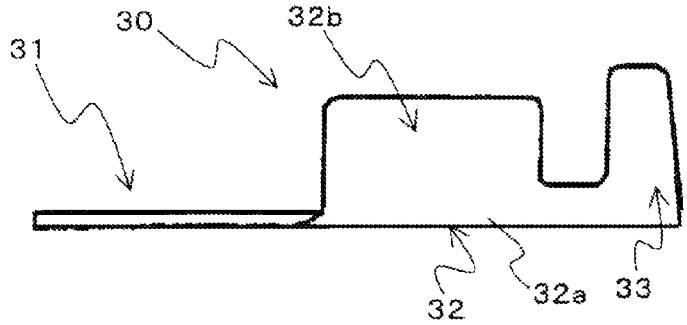
FIGS. 17A to 17D are diagrams illustrating a modified example of the crimp terminal illustrated in FIG. 13.
Figure 17B:
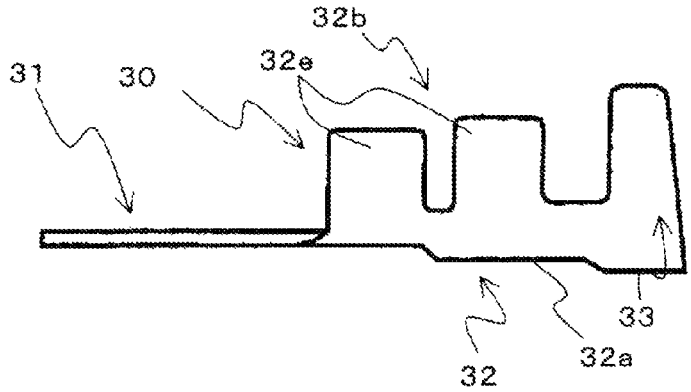

Alternatively, the bottom portion 32*a* may be stepped, and each of the pair of crimp flake portions 32*b* may be notched and divided into two pieces so that each of the pair of crimp flake portions 32*b* easily follows the steps 41 of the conductor portion 11, and the height of respective divided pieces 32*e* may be increased from the front end toward the rear end in a stepwise fashion (refer to FIG. 17B).

Figure 17C:
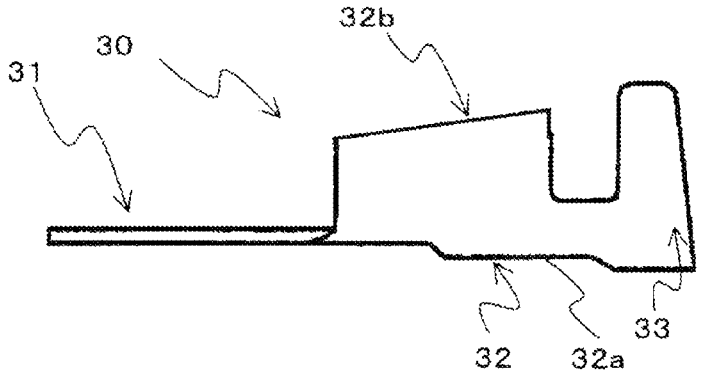

Alternatively, the bottom portion 32*a* may be stepped, and each edge surface of the pair of crimp flake portions 32*b* may be inclined so that the height of the edge surface gradually increases from the front end toward the rear end (refer to FIG. 17C).

Figure 17D:
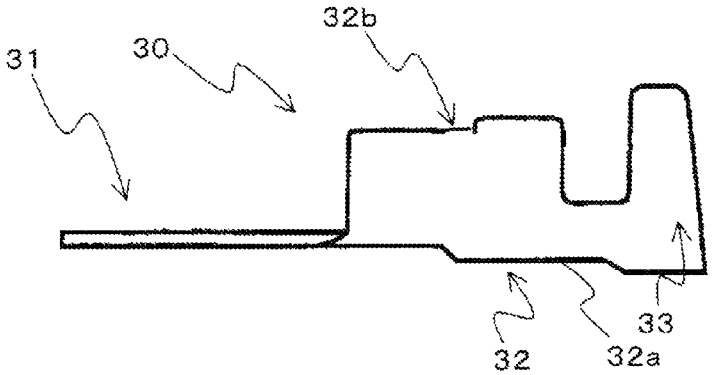

Alternatively, the bottom portion 32*a* and each edge surface of the pair of crimp flake portions 32*b* may be stepped (refer to FIG. 17D).

The insulating sheath crimping portion 33 is a portion in which the insulating sheath crimping portion 33 forms an end opposite to the partner connection portion 31 of the crimp terminal 30, and crimped onto the insulating sheath portion 13 to hold the electric wire 10. The insulating sheath crimping portion 33 includes a bottom portion 33*a* common with the bottom portion 32*a* of the conductor crimping portion 32, and a pair of crimp flake portions 33*b* obtained by erecting both edges of the bottom portion 33*a*. The pair of crimp flake portions 33*b* is bent inward with the use of a crimp jig not shown so as to be crimped onto the insulating sheath portion 13.

Subsequently, a description will be given of a procedure of folding back the radial outside element wire group 12 of the electric wire 3 according to the second embodiment of the present invention with reference to FIGS. 18A to 24B. FIGS. 18A to 24B are diagrams illustrating a procedure of folding back the radial outside element wire group 12 of the electric wire 3 according to the second embodiment of the present invention.

In each of FIGS. 18A to 24B, a left side (that is, FIGS. 18A, 19A, 20A, 21A, 22A, 23A and 24A) illustrates a diagram of the conductor portion 11 viewed from a lateral direction, and a right side (that is, FIGS. 18B, 19B, 20B, 21B, 22B, 23B, and 24B) illustrates a diagram of the conductor portion 11 viewed from an end surface direction.

Figure 18A:
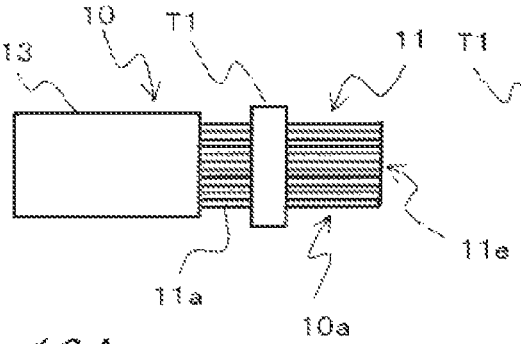
FIGS. 18A and 18B are diagrams illustrating a procedure of folding back an element wire group in a radial direction of the electric wire according to the second embodiment of the present invention.
Figure 18B:
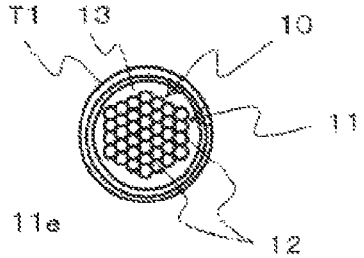
Figure 19A:
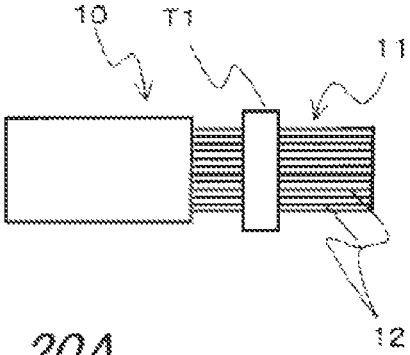
FIGS. 19A and 19B are diagrams illustrating the procedure of folding back the element wire group in the radial direction of the electric wire according to the second embodiment of the present invention.
Figure 19B:
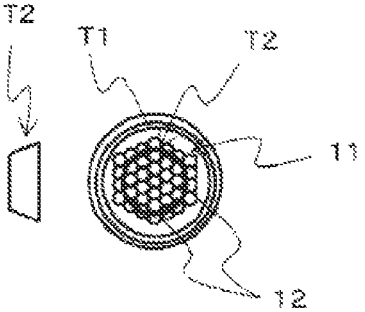
Figure 20A:
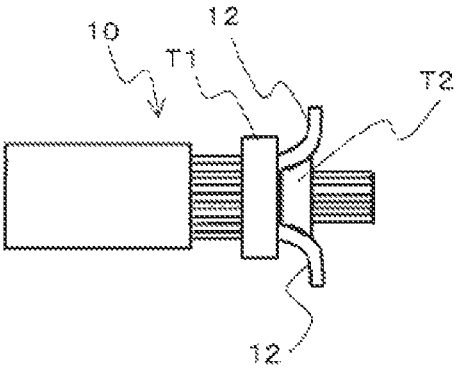
FIGS. 20A and 20B are diagrams illustrating the procedure of folding back an element wire group in the radial direction of the electric wire according to the second embodiment of the present invention.
Figure 20B:
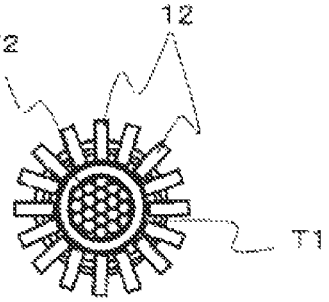
Figure 21A:
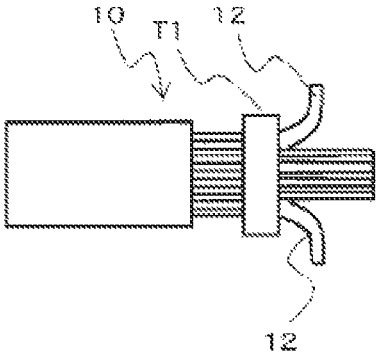
FIGS. 21A and 21B are diagrams illustrating the procedure of folding back an element wire group in the radial direction of the electric wire according to the second embodiment of the present invention.
Figure 21B:
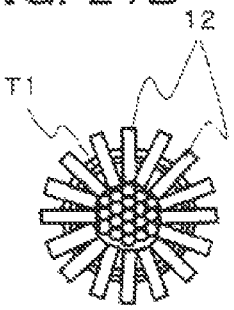
Figure 22A:
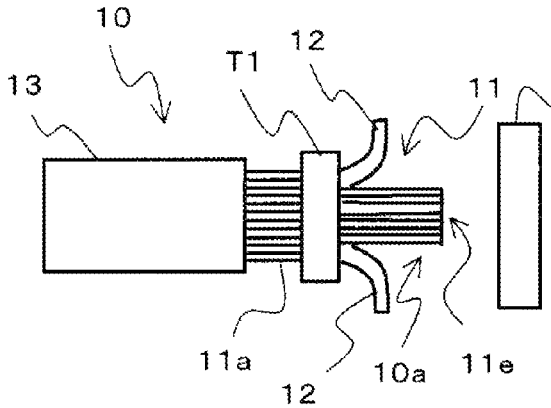
FIGS. 22A and 22B are diagrams illustrating the procedure of folding back an element wire group in the radial direction of the electric wire according to the second embodiment of the present invention.
Figure 22B:
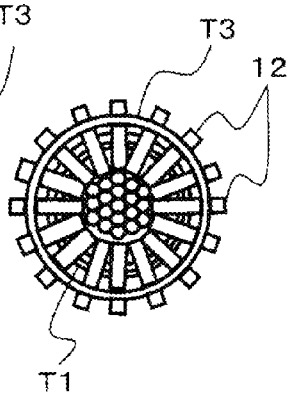
Figure 23A:
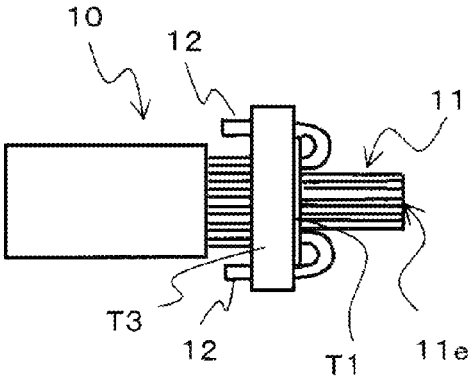
FIGS. 23A and 23B are diagrams illustrating the procedure of folding back an element wire group in the radial direction of the electric wire according to the second embodiment of the present invention.
Figure 23B:
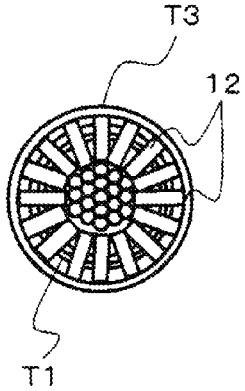

First, the worker inserts the exposed conductor portion 11 into a hole of a small ring member T1 which is a ring-shaped member having an inner diameter slightly larger than a diameter of the conductor portion 11 (refer to FIGS. 18A and 18B).

Thereafter, the worker inserts a bundle of the plural metal element wires 12 inside of the radial outside element wire group 12 into a hole of a cylindrical member T2 having one end portion opening larger in diameter than the other end portion opening (refer to FIGS. 19A to 21B). In this example, the bundle of plural metal element wires 12 disposed inside is inserted into the hole of the cylindrical member T2 from the end portion opening side of the cylindrical member T2, which is smaller in the diameter. The radial outside element wire group 12 is bent outward in the radial direction while being guided along an outer surface of the cylindrical member T2. The cylindrical member T2 is removed after the radial outside element wire group 12 has been bent.

Thereafter, the worker inserts the exposed conductor portion 11 into a large ring member T3 which is a ring-shaped member having an inner diameter slightly larger than the diameter of the small ring member T1 (refer to FIGS. 22A to 23B). As a result, the radial outside element wire group 12 is folded back in the direction opposite to the end surface 11*e* of the conductor portion 11 in the extension direction. That is, the worker folds back the plurality of element wires 12 without cutting the element wires in alignment, to thereby easily expose the metal element wires 12 arranged inside of the conductor portion 11 in the radial direction.

Figure 24A:
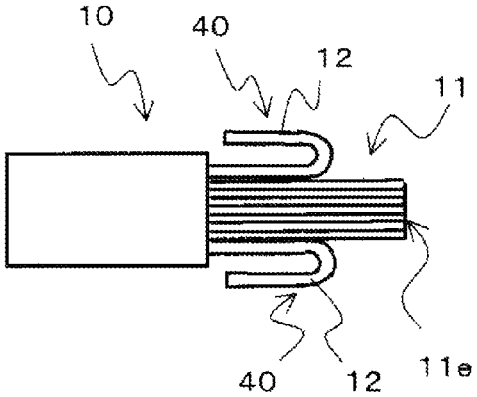
FIGS. 24A and 24B are diagrams illustrating the procedure of folding back an element wire group in the radial direction of the electric wire according to the second embodiment of the present invention.
Figure 24B:
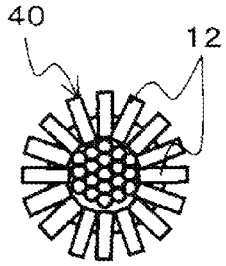

Then, after having removed the small ring member T1 and the large ring member T3, the worker crimps the crimp terminal 30 onto the electric wire 10 with the use of the crimp jig not shown (refer to FIGS. 24A and 24B). As a result, the work is completed. That is, the conductor crimping portion 32 is crimped onto the exposed stepped conductor portion 11, and not only the radial outside element wire group 12 is connected to the conductor portion, but also the outer peripheral surface of the bundle of plural metal element wires 12 arranged inside in the radial direction is connected to the crimp terminal 30.

In the electric wire 3 with the crimp terminal according to the second embodiment of the present invention, the exposed conductor portion 11 has the outside element wire folded portion 40 configured such that the plurality of metal element wires 12 arranged in the circumferential direction, outside in the radial direction is folded back in a direction opposite to the end surface 11*e* of the conductor portion 11 along the extension direction. Therefore, the plurality of metal element wires 12 is bent without being cut in alignment, to thereby easily expose the metal element wires 12 arranged inside of the conductor portion 11 in the radial direction. As a result, the connection stability of the crimp terminal 30 and the electric wire 10 can be improved without making the fixing work of the crimp terminal 30 troublesome.

Figure 25:
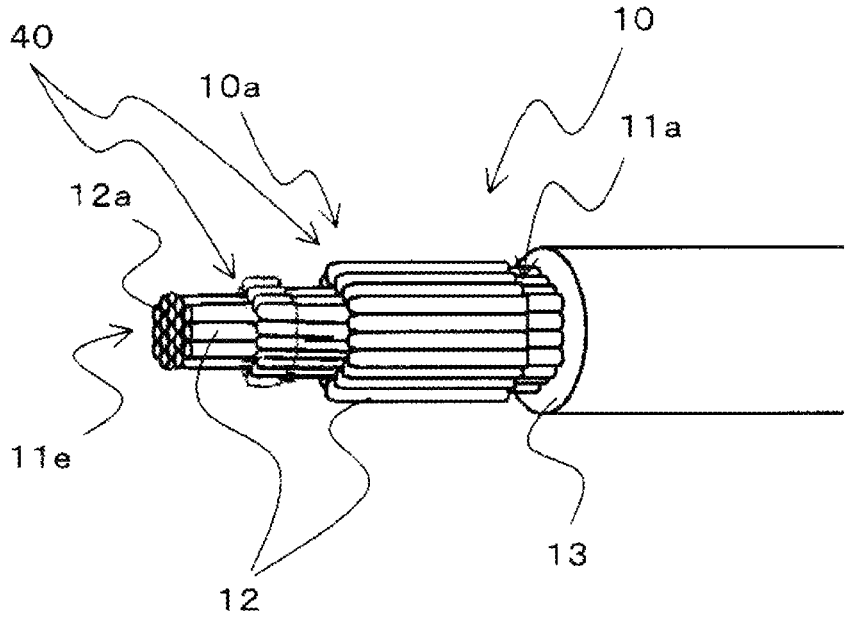
FIG. 25 is a perspective view illustrating an electric wire according to a modified example of the electric wire with a crimp terminal illustrated in FIG. 13.

In the electric wire 3 with the crimp terminal according to the second embodiment of the present invention, the plurality of metal element wires 12 arranged outermost in the radial direction. However, the present invention is not limited to this configuration, but as illustrated in FIG. 25, the plurality of metal element wires 12 arranged along the circumferential direction may be divided into a plurality of steps, and folded back.

Also, in the electric wires 1 and 2 with the crimp terminal according to the first and second embodiments of the present invention, the circular through-hole 31*a* is formed roughly in the center of the flat plate having the outer circular shape. However, the present invention is not limited to this configuration. For example, a male terminal protruded into a bar shape, or a female terminal having a box shape inside of which an elastic contact piece is formed.

It is apparent that various modifications can be made in the invention within a scope not deviating from the gist of the invention.

The present application is based on Japanese patent application No. 2012-060302 filed on Mar. 16, 2012, and the contents of the patent application are incorporated herein by reference.

The invention claimed is:

1. An electric wire with a crimp terminal, comprising:

a conductor portion including a first plurality of metal element wires and a second plurality of metal element wires, the first plurality of element wires defining an outer peripheral surface of the conductor portion into which the first and second pluralities of metal element wires are bundled together and covered with an insulating sheath portion, the conductor portion of a terminal portion of the electric wire being exposed, and the conductor portion terminating at an end surface, and a conductor crimping portion of the crimp terminal that is crimped onto the exposed conductor portion, wherein each of the first plurality of metal element wires terminates at a terminal end, wherein each of the second plurality of metal element wires terminates at a terminal end that defines the end surface of the conductor portion, and wherein the exposed conductor portion has an outside element wire folded portion configured such that each of the first plurality of metal element wires is arranged in a circumferential direction, and outermost in a radial direction with respect to the second plurality of metal element wires, and each of the first plurality of metal element wires is folded back in a direction opposite to the end surface of the conductor portion along an extension direction such that the terminal ends of the first plurality of metal element wires are spaced inwardly from the end surface of the conductor portion in the extension direction.

2. An electric wire with a crimp terminal, comprising:

a conductor portion, an outer peripheral surface of the conductor portion into which a plurality of metal element wires is bundled together being covered with an insulating sheath portion into the electric wire, the conductor portion of a terminal portion of the electric wire being exposed, and the conductor portion terminating at an end surface, and a conductor crimping portion of the crimp terminal that is crimped onto the exposed conductor portion, wherein the exposed conductor portion has an outside element wire folded portion configured such that the plurality of metal element wires arranged in a circumferential direction, outside in a radial direction is folded back in a direction opposite to the end surface of the conductor portion along an extension direction, and the outside wire element folded portion contacts at least one of the plurality of metal element wires that is separate from the outside wire element folded portion, and wherein the plurality of metal element wires arranged in the circumferential direction are divided into a plurality of steps in the radial direction, and folded back.

* * * * *